US005168695A

United States Patent [19]

Stahlecker

[11] Patent Number: 5,168,695

[45] Date of Patent: Dec. 8, 1992

[54] TUBE TRANSPORT APPARATUS WITH INTERMEDIATE STATIONARY MAGAZINES DISPENSABLE TO SERVICE CARRIAGE

[75] Inventor: Fritz Stahlecker, Bad Überkingen, Fed. Rep. of Germany

[73] Assignee: Hans Stahlecker, Fed. Rep. of Germany; a part interest

[21] Appl. No.: 615,278

[22] Filed: Nov. 19, 1990

[30] Foreign Application Priority Data

Dec. 2, 1989 [DE] Fed. Rep. of Germany ..... 3939924

[51] Int. Cl.[5] ..... D01H 9/10

[52] U.S. Cl. ..... 57/281; 57/271

[58] Field of Search ..... 57/268, 270, 271, 276, 57/90, 266, 264

[56] References Cited

U.S. PATENT DOCUMENTS 4,155,513 5/1979 Maassen ..... 57/270 X
4,676,061 6/1987 Yamamoto ..... 57/90 X
4,702,427 10/1987 Raasch ..... 242/35.5 A
4,703,618 11/1987 Dinkelmann ..... 57/281 X
4,785,619 11/1988 Stahlecker et al. ..... 57/281 X
4,897,991 2/1990 Rohner et al. ..... 57/281

FOREIGN PATENT DOCUMENTS 2737645 1/1979 Fed. Rep. of Germany .
2506417 11/1986 Fed. Rep. of Germany .

*Primary Examiner*—Daniel P. Stodola
*Assistant Examiner*—John Rollins
*Attorney, Agent, or Firm*—Evenson, Wands, Edwards, Lehahan & McKeown

[57] ABSTRACT

In the case of an arrangement for the filling of a magazine of a movable package spool changing arrangement with tubes, at least one intermediate magazine is provided to which the magazine of the package spool changing arrangement can be applied and at which a continuous transport device passes by from which individual tubes can be removed and can be filled into the intermediate magazine.

24 Claims, 6 Drawing Sheets

TUBE TRANSPORT APPARATUS WITH INTERMEDIATE STATIONARY MAGAZINES DISPENSABLE TO SERVICE CARRIAGE

BACKGROUND AND SUMMARY OF THE INVENTION

The invention relates to an arrangement for filling a magazine of a movable spool package changing arrangement or doffing apparatus with tubes which, for carrying out a package spool changing operation, can be applied to the individual working positions of a machine which each produces one spool package and can be applied for taking over tubes from an intermediate magazine.

In a known arrangement of the initially mentioned type (German Patent Document DE-A 27 37 645), an intermediate magazine is provided at a machine end which can be swivelled around a vertical axis in such a manner that it can be assigned to movable spool package changing arrangements which in each case service one side of the machine. The intermediate magazine is provided so that conical spool tubes having a starter winding with a predetermined direction can be supplied in an orderly manner by a spool feeding device to the two spool package changing arrangements.

It is also known (German Patent Document DE-C 25 06 417) to arrange an intermediate magazine at each working position of the machine which stores one spare tube respectively. The intermediate magazine is supplied with tubes by a circulating chain conveyor. For this purpose, the intermediate magazines can be adjusted in such a manner that they can be moved into the moving range of the chain conveyor so that they remove one tube respectively from the chain conveyor.

It is an object of the invention to provide an arrangement of the initially mentioned type which makes it possible to make available to the movable spool package changing device respective empty tubes rapidly and in a sufficient quantity.

This object is achieved in that a transport device for the feeding of tubes is provided which moves continuously past the intermediate magazine, and in that devices for removing tubes which pass by from the transport device and for refilling the intermediate magazine are assigned to the intermediate magazine.

In this development, the continuously running transport device is used as the main magazine which fills the intermediate magazine constantly, if required. It therefore becomes possible to constantly keep a sufficiently large number of tubes available in the area of the intermediate magazine and thus also in the area of the movable spool package changing arrangement so that a spool package changing operation can be carried out without interruption.

In a further development of the invention, it is provided that several intermediate magazines are provided distributed along the length of the machine. This has the advantage that, on the one hand, the movable spool package changing device, in each case, for the refilling of its magazine can travel to the closest intermediate magazine. In addition, this development has the advantage that virtually always a full intermediate magazine is available because one of the intermediate magazines will always be filled with tubes.

In the case of a simple embodiment of the invention, it is provided that the intermediate magazine is a shaft-type compartment having a filling opening facing the transport device and having an openable bottom to which the magazine of the spool package changing arrangement can be applied. Filling an intermediate magazine of this type is just as simple as emptying it because the tubes can move as a result of the force of gravity without the requirement of additional transfer elements.

In a further development of the invention, an endless conveying trough is provided which has a width that is adapted to the diameter of the tubes, a drivable belt guided upright being used as its bottom. As a result, an extremely simple construction is obtained, particularly since the belt can very easily be guided around the machine. The narrow side of the belt offers a sufficient pulling force for bringing the tubes to the intermediate storage device or devices.

In a further development of the invention, devices for the braking of the tubes carried along by the transport device are provided in front of the intermediate magazine in the moving direction. As a result, it is ensured that the tubes are not distributed on the transport device in any arbitrary manner but are essentially available in front of the intermediate magazine or magazines so that, as required, the intermediate magazines may be refilled with them.

In a further development of the invention, it is provided that the devices for the braking are constructed as an additional conveying device which is arranged in the area of the intermediate magazine and takes the tubes from the transport device moving at a higher transport speed and, after passage through the additional conveying device, transfers them back to the transport device. By means of the slower-moving additional conveying device, it is achieved that the tubes are collected in the area in front of the intermediate magazine. In addition, it is achieved that the tubes are conveyed faster behind the additional conveying device so that a separating of the tubes takes place which makes it possible that, as required, these can be filled into the intermediate magazine correspondingly separately.

Other objects, advantages and novel features of the present invention will become apparent from the following detailed description of the invention when considered in conjunction with the accompanying drawings.

DETAILED DESCRIPTION OF THE DRAWINGS

Figure 1:
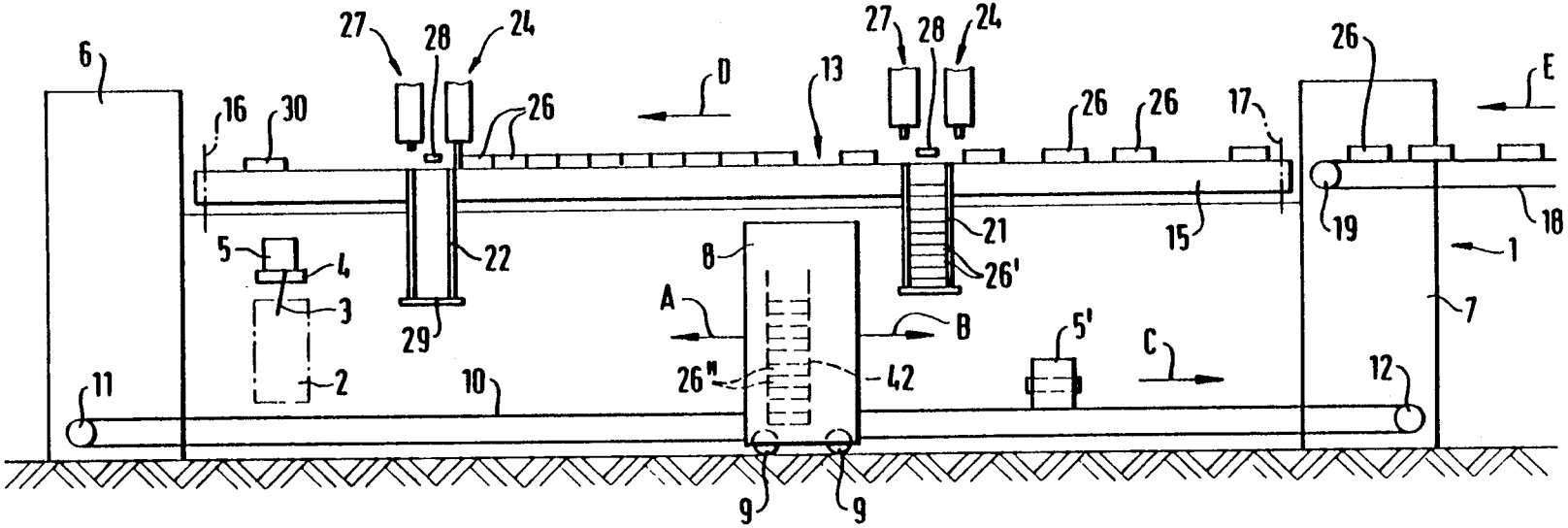
FIG. 1 is a schematic front view of a machine which is equipped with an arrangement constructed according to a preferred embodiment of the invention.
Figure 2:
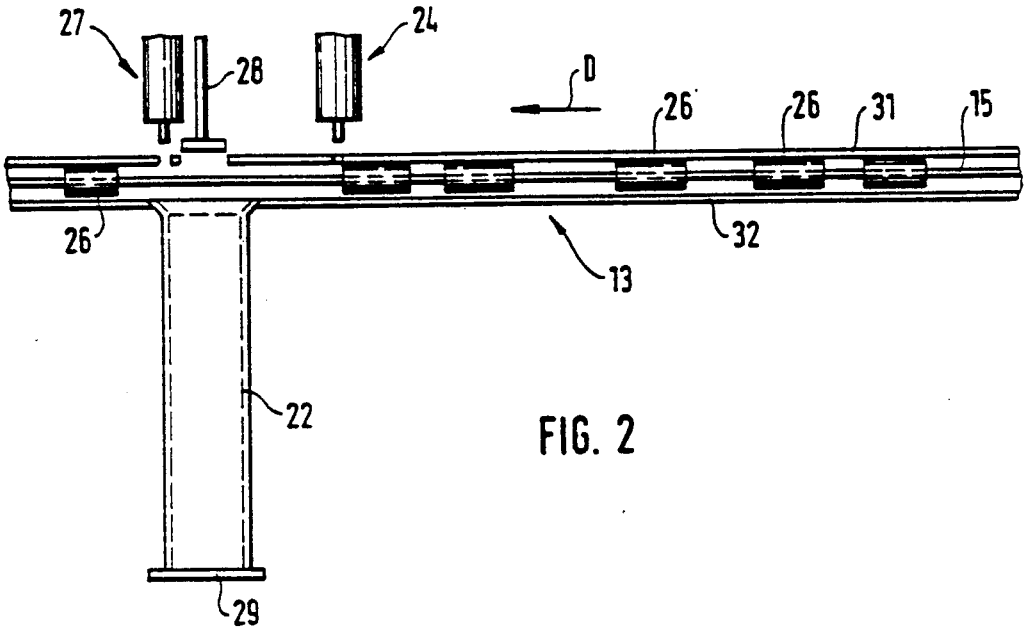
FIGS. 2 to 5 are schematic representations of a first possibility for refilling tubes into an intermediate magazine.

FIG. 1 schematically illustrates a spinning machine 1 of a construction which is arbitrary per se and which has a plurality of working positions 2 arranged next to one another, of which only one is shown. Each of these working positions 2 guides a yarn 3 to a wind-up arrangement 4 which winds the yarn 3 onto a cross-wound spool package 5. The spinning machine I is bounded at both ends by end frames 6, 7 in which the drives and transmissions are housed which, among other things, also drive the wind-up arrangement 4.

A spool package changing arrangement 8 travels along the spinning machine I, is equipped with a running gear 9 and patrols along one side of the machine in the direction of the arrows (A and B). As a deviation from the shown embodiment, the spool package changing arrangement 8 may also drive around the spinning machine 1.

The movable spool package changing arrangement 8 carries out an exchange of spool packages at the individual working positions, for the purpose of which it takes a full package from working position 2 and transfers it to a transport device which, corresponding to FIG. 1, is constructed as a conveyor belt 10 extending through in the longitudinal direction of the machine which, in the area of the end frames, is guided by way of deflecting rollers 11, 12 of which at least one is drivable. The spool packages 5' which are conveyed on the conveyor belt 10 in the direction of the arrow (C), in a manner not shown in detail, are taken off in the area of an end frame 7 and are, for example, packaged or guided to another processing machine.

When the spool package changing arrangement 8 takes a full package 5 from a working position 2, it immediately afterwards places an empty tube 26" in this working position 2. It removes this empty tube 26" from a magazine that can move along with it.

Figure 6:
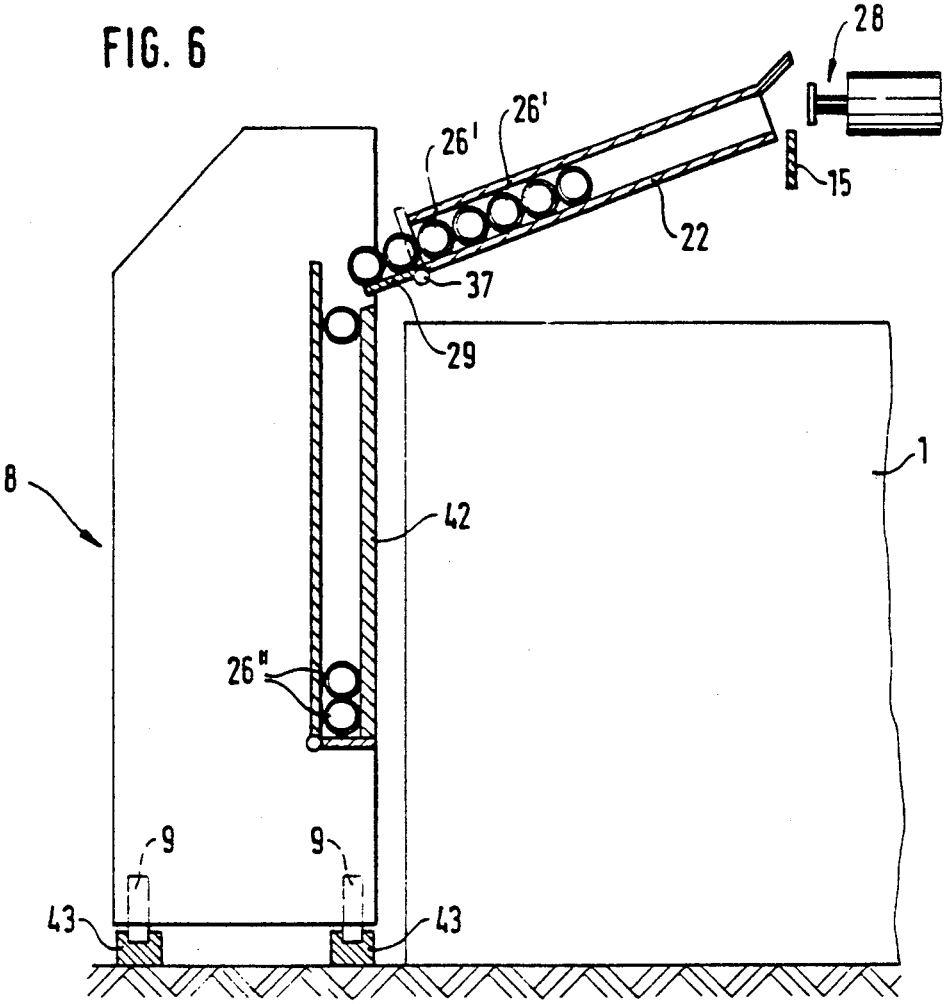
FIG. 6 is a partially sectional, schematic view of a machine in the area of an intermediate storage device and a spool package changing device applied to it during the filling of the magazine of the spool package changing arrangement.

Since the magazine 42 of the spool package changing arrangement 8 can accommodate only a finite number of tubes 26", this magazine 42 must be refilled as soon as the tubes 26" are used up. For this purpose, the spool package changing arrangement 8 travels to an intermediate storage device 21 or 22 which holds available a corresponding quantity of tubes 26'. As shown particularly in FIG. 6, the intermediate storage device 21, 22 is developed as a shaft-type compartment which has a filling opening situated on top and a delivery opening situated on the bottom which is closed off by a flap 29 which can be swivelled around an axis 37. The intermediate storage devices 21, 22 are preferably arranged above the spinning machine 1. They are arranged with a slope of approximately 20° with respect to the horizontal line which is sufficient for the tubes 26' to automatically leave the intermediate storage device 22 as a result of gravity as soon as the flap 29 is opened. The spool package changing arrangement 8 is equipped with a gripper which is not shown and which grips the flap and thus opens the discharge opening. The flap 29 then places itself as a guiding surface over the magazine 42 of the spool package changing device 8 which is also constructed as a shaft-type compartment so that the empty tubes 26' fall from the storage device 22 into the magazine 42.

Figure 9:
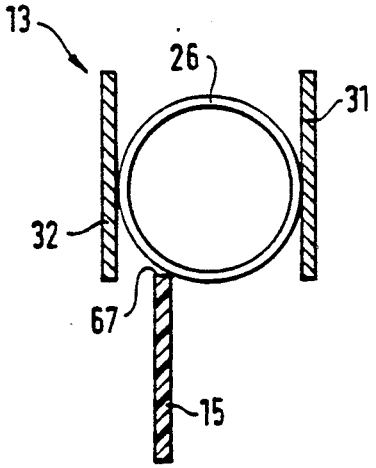
FIG. 9 is a sectional view through the transport device.

After one of the intermediate magazines 21, 22 has been emptied, it must also be refilled. For this purpose, empty tubes 26 are guided to the inlet openings of the intermediate storage devices 21 by means of a continuously circulating transport device 13. This transport device 13 comprises a conveying trough surrounding the machine which is illustrated particularly in FIG. 9. This transport device 13 has two lateral guiding walls 31, 32 which are arranged at a distance adapted to the diameter of the tubes 26. An endless circulating belt 15 which is guided upright is used as the bottom of the conveying trough and takes along the tubes 26 with one front face 67. As indicated in FIG. 1 by means of dash-dotted lines 16, 17, the belt 15 is deflected and driven in the area of the machine ends. The continuous transport device 13 which is used as the main magazine for tubes 26, by way of a feeding device 18, is supplied with empty tubes 26 which, for example, in the area of the end frame 7, transfers these tubes 26 to the transport device 13. The feeding devices 18 comprises, for example, a conveyor belt which runs around a deflecting roller 19 and which comes from a supply point or another machine, such as a spooling machine or a twisting machine and returns the empty tubes 26.

For the refilling of an empty intermediate magazine, for example, intermediate magazine 22 of FIG. 1, the tubes circulating on the transport device 13 are collected in front of this intermediate magazine 22 so that the refilling of the intermediate magazine 22 can be carried out fast and without interruption. The tubes 26 pass by the other intermediate magazine 21 which is full and therefore does not have to be refilled.

Figure 3:
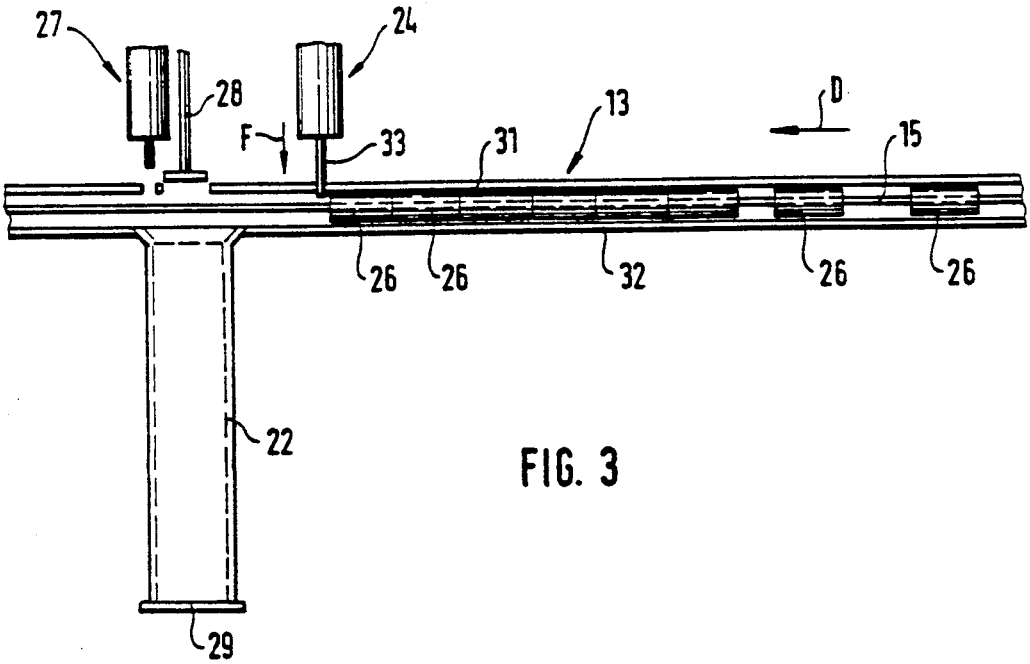
Figure 4:
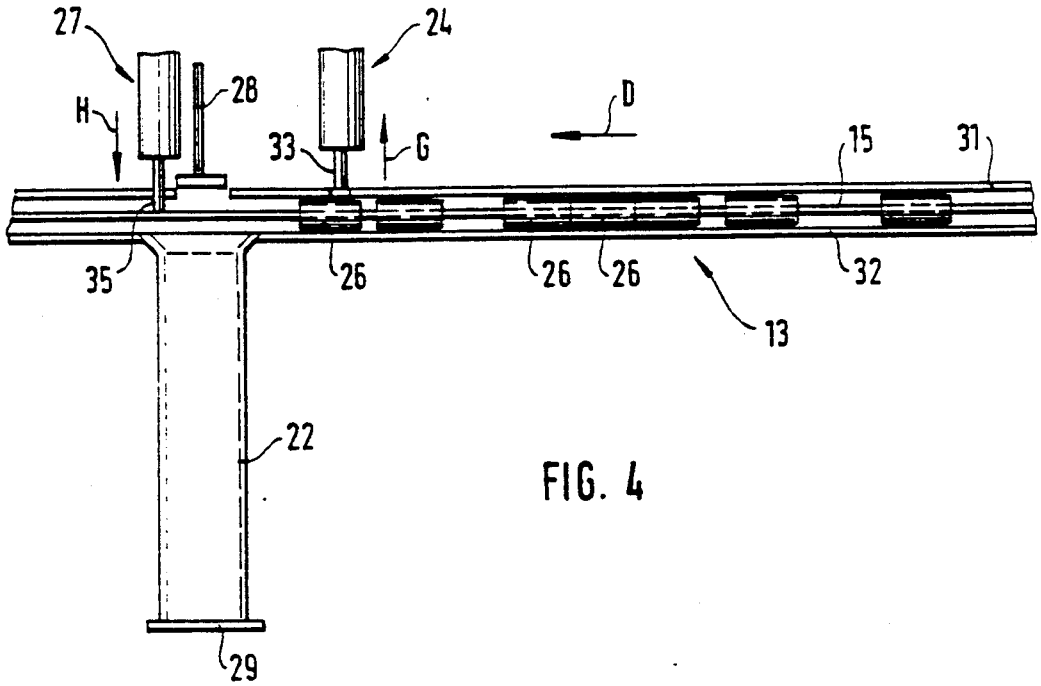
Figure 5:
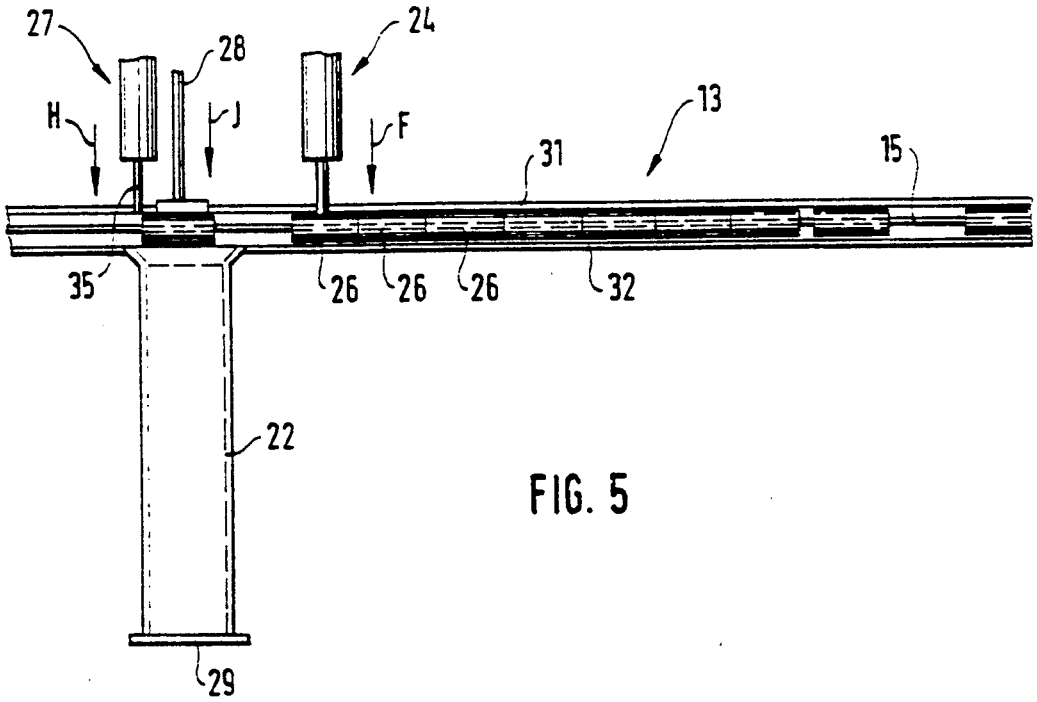

A first embodiment of the devices for the collecting and transferring of tubes 26 to an intermediate magazine 22 is illustrated in FIGS. 2 to 5 in the different transfer phases. First, the tubes 26 are taken along at irregular intervals by the transport device 13 in the direction of the arrow. They are aligned in the longitudinal direction of the belt 15 with their longitudinal axis. After the intermediate magazine 22 has been emptied by transferring the tubes 26 previously present in it to the magazine of the spool package changing arrangement 8, a braking device is first actuated which, through the rear guiding wall of the conveying trough 13, introduces a piston 33 in the direction of the arrow (F) into the moving path of the tubes 26. The tubes 26 which are taken along by the transport device 13 are therefore braked and collected so that they accumulate in front of the intermediate magazine 22 and form a column of tubes 26, as illustrated in FIG. 3. Then the piston 33 is retracted for a short period of time so that the tubes 26 are again taken along by the belt 15 (FIG. 4). After a tube 26 has moved beyond the area of the braking device 24, the piston 33 is moved out again so that the tubes 26 are braked again. The separated tube 26 will then continue to travel in the direction of the intermediate magazine 22 in the area of which it is then stopped by means of a positioning device 27 which moves out a piston 35 into the moving path of the tubes 26 in the direction of the arrows (H). As soon as the presence of a tube 26 has been recognized in this position, an ejector 28 is moved out in the direction of arrow (I) which presses the tube 26 into an inlet funnel of the intermediate magazine 22. This operation is repeated until the intermediate magazine 22 is filled with the predetermined number of tubes 26. After the predetermined number of tubes 26 was introduced into the intermediate magazine 22, a corresponding signal is emitted by a signal generator which is not shown which makes the braking device 24, the holding device 27 and the ejector 28 inoperative. The tubes 26 are then driven past this magazine 22.

Figure 7:
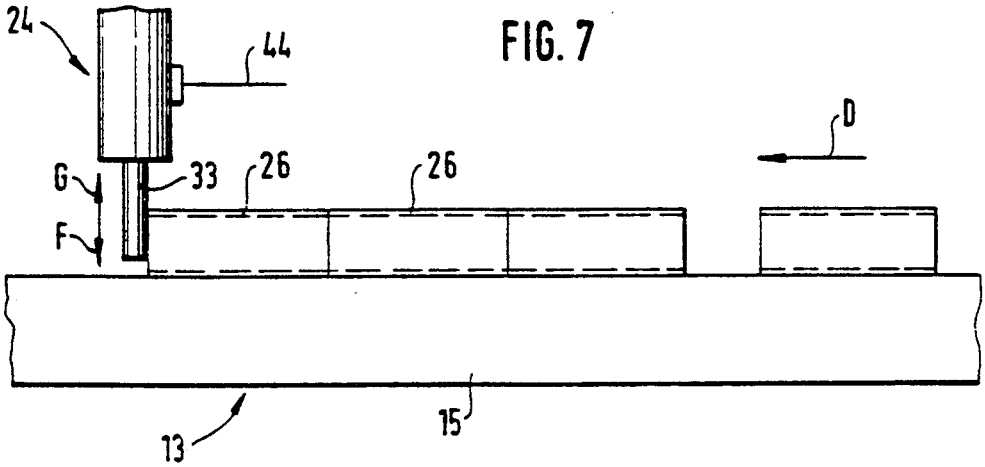
FIG. 7 is a schematic representation of a device for braking and for collecting tubes on the transport device.

In FIG. 7, the braking device 24 is shown again at an enlarged scale. It may be constructed, for example, as a hydraulic or pneumatic cylinder which is controlled by means of a solenoid valve 44. The braking device 24 is designed such that its piston 33 can move into the moving path of the tubes 26. However, it is designed such that in cases where, when moving out, it strikes against the circumference of a tube 26 beforehand, it also comes to a stop in this position so that a destruction of the tubes 26 is avoided.

Figure 8:
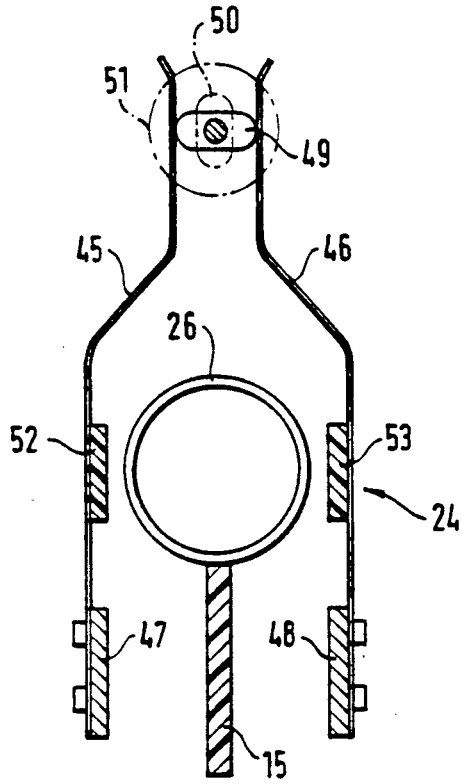
FIG. 8 is a schematic view of another device for collecting and braking the tubes on the transport device.

FIG. 8 illustrates another embodiment of a braking device 24. This braking device comprises two leaf springs 45, 46 which are fastened to holders 47, 48 and which are provided with brake linings 52, 53 situated on both sides of the tube 26 which is transported on the transport belt 15. The leaf springs 45, 46, by means of a spreading element which can be rotated by way of a gear wheel or a friction wheel, are brought into the shown inoperative position or into the braking position which is not shown in which the spreading element 49 was twisted by 90° into position 50. The brake linings 52, 53 will then be situated in the moving path of the tubes 26.

Figure 10:
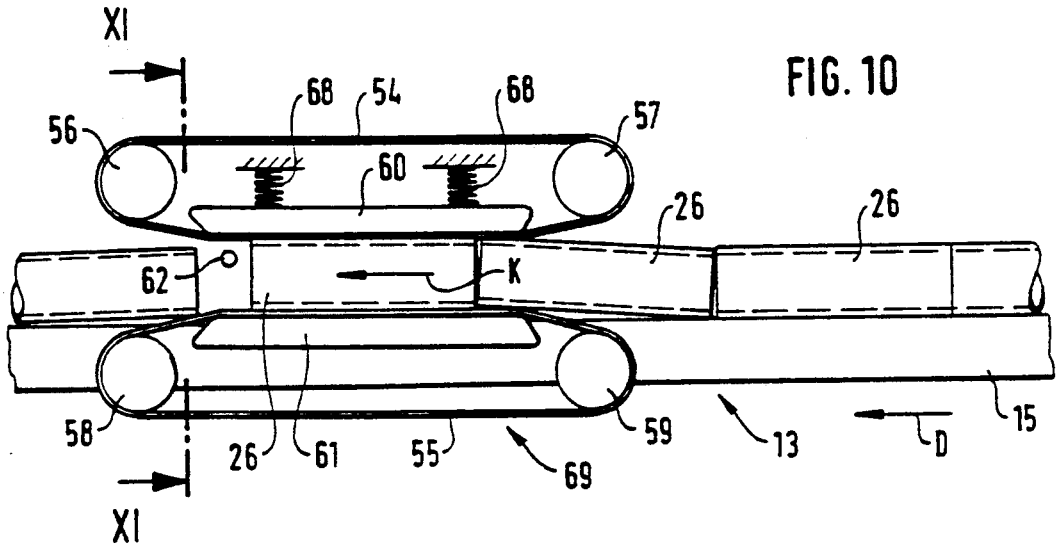
FIG. 10 is another embodiment for collecting and separating the tubes in the area of an intermediate magazine.
Figure 11:
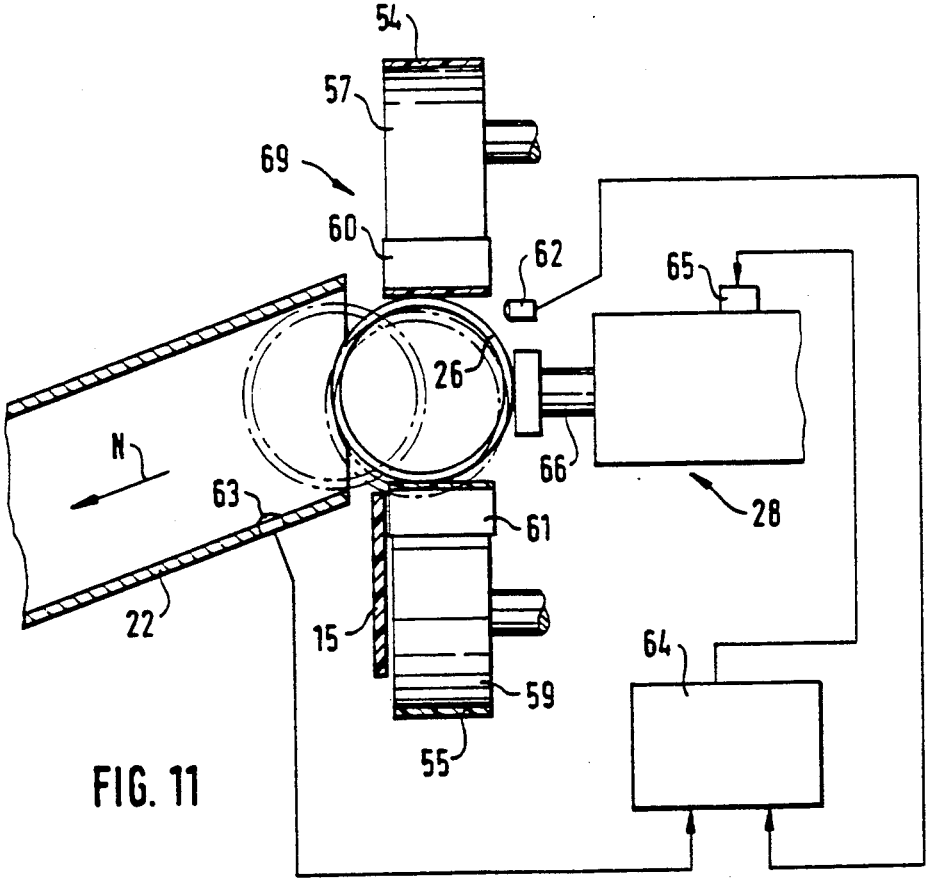
FIG. 11 is a sectional view along Line XI—XI of FIG. 10 during the operation of a refilling of an intermediate magazine.

Another embodiment of a braking device 69 is illustrated in FIGS. 10 and 11, an ejector 28 being assigned to it. The embodiment according to FIG. 10 and 11 has the advantage that the braking device 69 operates continuously so that, if required, only the ejector 28 is actuated. The braking device 69 is constructed as a conveying device which, in the area of the inlet opening of the intermediate storage device 22, takes over the conveying of the tubes 26 and in the process lifts them off the belt 15. For this purpose, two transport belts 54, 55 are provided which are endlessly guided around deflecting rollers 56, 57 and 58, 59, one of which respectively being drivable. The driving takes place in such a manner that the tube 26 taken up between the two transport belts 54, 55 and in the process lifted off the belt 15, is moved at a reduced speed which is significantly slower than the speed of the belt 15. As a result, a braking takes place of the tube 26 which is received in the braking device 69. This tube 26 is clamped in between the two ends of the belts 54, 55. In the area opposite the tube 26, these belts 54, 55 move over skids 60, 61 of which the skid facing away from the belt 15 is flexibly held by means of springs 68. The tube 26 which is held between the conveyor belts 54, 55 is conveyed at a speed that is clearly reduced in comparison to that of belt 15 so that the tubes 26 which follow run up against it and are collected in the form of a column.

In the area in which the tubes 26 already leave the braking device 69, a detector 62 is arranged which detects the arrival of a front edge of a tube 26 and reports it to a control 64. This tube 26 will then be in a position which is suitable for the transfer. The control device 64 will then actuate the ejector 28 so that its piston 66 is moved out, in which case the tube 26 is knocked out from between the two conveyor belts 54, 55 by means of a fast, jerky movement and is transferred to the intermediate magazine 22. The ejector 28 is constructed as a hydraulic or pneumatic cylinder which is controlled by means of a solenoid valve 65.

In the inlet area of the intermediate magazine 22, another detector 63 is provided which is connected with the control 64. This detector 63 reports when the intermediate magazine 22 is full; i.e., a tube 26 remains in its area for a predetermined time period. In this case, the control 64 provides that the ejector 28 is not actuated despite a signal of the detector 62.

The detector 62 is arranged in the outlet area of the braking device 69 in such a manner that it can respond to the front edge of a tube 26 although previously this tube was pushed together in the manner of a column and therefore almost without any seams. The reason is that when a tube 26 has passed through the braking device 69, it is taken along again by the belt 15 moving at a higher speed so that, in the process, it is withdrawn from the front edge of the following tube 26 so that this front edge is exposed and can be detected by the detector 62.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Apparatus for supplying spool tubes to a movable spool package changing device of the type which is selectively applied to individual spool package producing positions of a machine, comprising:

at least one stationary intermediate magazine disposed along and intermediate end points of a path for a movable spool changing device, said intermediate magazine serving to store spool tubes for direct transfer to the movable spool changing device when said changing device is in a position adjacent to and in communication with said at least one intermediate magazine, a tube transport device for carrying a supply of tubes and serving as a main magazine for supplying tubes to the machine, said tube transport device being continuously movable past the intermediate magazine, and an intermediate magazine tube refilling device for removing tubes from the tube transport device to refill the intermediate magazine with said tubes.

2. Apparatus according to claim 1, wherein the intermediate magazine includes a shaft compartment with a filling opening facing the tube transport device and an openable bottom to which a magazine of the movable spool changing device can be applied.

3. Apparatus according to claim 1, wherein said tube transport device includes an endless conveyor which is continuously movable past the intermediate magazine.

4. Apparatus according to claim 1, wherein a plurality of intermediate magazines are included which are distributed, spaced from one another, along the length of the path for the movable spool changing device.

5. Apparatus according to claim 4, wherein tube separating devices are provided for separating tubes on the tube transport device for transfer to the respective intermediate magazines.

6. Apparatus according to claim 4, wherein braking devices for braking the tubes carried along by the tube transport device are provided in the travelling direction in front of the respective intermediate magazines.

7. Apparatus according to claim 4, wherein the tube transport device is constructed as an endless conveyor trough which has a width that is adapted to the diameter of the tubes and a drivable belt which is guided upright serving as a bottom of the conveyor trough.

8. Apparatus according to claim 4, wherein the intermediate magazines each include a shaft compartment with a filling opening facing the tube transport device and an openable bottom to which a magazine of the movable spool changing device can be applied.

9. Apparatus according to claim 8, wherein the tube transport device is constructed as an endless conveyor trough which has a width that is adapted to the diameter of the tubes and a drivable belt which is guided upright serving as its bottom.

10. Apparatus according to claim 9, wherein braking devices for braking the tubes carried along by the tube transport device are provided in the travelling direction in front of the respective intermediate magazines.

11. Apparatus according to claim 10, wherein tube separating devices are provided for separating tubes on the tube transport device for transfer to the respective intermediate magazines.

12. Apparatus according to claim 11, wherein tube transfer devices for transferring tubes moved by on the tube transport device are assigned for transferring tubes to the intermediate magazines and are equipped with a control which is connected with devices for recognizing a tube situated on the tube transport device and devices for recognizing a requirement of the respective intermediate magazine to be refilled.

13. Apparatus for supplying spool tubes to a movable spool package changing device of the type which is selectively applied to individual spool package producing positions of a machine, comprising:

an intermediate magazine disposed along a path for a movable spool changing device, said intermediate magazine serving to store spool tubes for transfer to the movable spool changing device.

a tube transport device for carrying a supply of tubes, said tube transport device being continuously movable past the intermediate magazine, and an intermediate magazine tube refilling device for removing tubes from the tube transport device to refill the intermediate magazine with said tubes, wherein the tube transport device is constructed as an endless conveyor trough which has a width that is adapted to the diameter of the tubes and a drivable belt which is guided upright serving as a bottom of the conveyor trough.

14. Apparatus according to claim 13, wherein braking devices for braking the tubes carried along by the tube transport device are provided in the travelling direction in front of the intermediate magazine.

15. Apparatus according to claim 14, wherein the braking devices for the braking are constructed as an additional conveying device arranged in the area of the intermediate magazine which takes over the tubes from the tube transport device moving at a higher transport speed and after the passage through the additional conveying device, transfers them back to the tube transport device.

16. Apparatus according to claim 15, wherein the additional conveying device is designed as a double-belt unit, the belts of which clamp in between them and take along one tube respectively.

17. Apparatus according to claim 16, wherein the double belt unit is arranged in the conveying trough next to and in an elevated manner next to the drivable belt which is guided upright.

18. Apparatus according to claim 16, wherein a device for the ejecting of a tube guided in the double belt unit is arranged laterally next to this double belt unit on one side and the filling opening of the intermediate magazine is arranged on the other side.

19. Apparatus for supplying spool tubes to a movable spool package changing device of the type which is selectively applied to individual spool package producing positions of a machine, comprising:

an intermediate magazine disposed along a path for a movable spool changing device, said intermediate magazine serving to store spool tubes for transfer to the movable spool changing device, a tube transport device for carrying a supply of tubes, said tube transport device being continuously movable past the intermediate magazine, and an intermediate magazine tube refilling device for removing tubes from the tube transport device to refill the intermediate magazine with said tubes, wherein braking devices for braking the tubes carried along by the tube transport device are provided in the travelling direction upstream of the intermediate magazine.

20. Apparatus according to claim 19, wherein the braking devices for the braking are constructed as an additional conveying device arranged in the area of the intermediate magazine and which takes over the tubes from the tube transport device moving at a higher transport speed and after the passage through the additional conveying device, transfers the tubes back to the tube transport device.

21. Apparatus according to claim 20, wherein the additional conveying device is designed as a double-belt unit, the belts of which clamp in between them and take along one tube respectively.

22. Apparatus according to claim 21, wherein a device for the ejecting of a tube guided in the double belt unit is arranged laterally next to this double belt unit on one side and the filling opening of the intermediate magazine is arranged on the other side.

23. Apparatus for supplying spool tubes to a movable spool package changing device of the type which is selectively applied to individual spool package producing positions of a machine, comprising:

an intermediate magazine disposed along a path for a movable spool changing device, said intermediate magazine serving to store spool tubes for transfer to the movable spool changing device, a tube transport device for carrying a supply of tubes, said tube transport device being continuously movable past the intermediate magazine, and an intermediate magazine tube refilling device for removing tubes from the tube transport device to refill the intermediate magazine with said tubes, wherein tube separating devices are provided for separating tubes on the tube transport device for transfer to the intermediate magazine.

24. Apparatus for supplying spool tubes to a movable spool package changing device of the type which is selectively applied to individual spool package producing positions of a machine, comprising:

an intermediate magazine disposed along a path for a movable spool changing device, said intermediate magazine serving to store spool tubes for transfer to the movable spool changing device, a tube transport device for carrying a supply of tubes, said tube transport device being continuously movable past the intermediate magazine, and an intermediate magazine tube refilling device for removing tubes from the tube transport device to refill the intermediate magazine with said tubes, wherein tube transfer devices for transferring tubes moved by on the tube transport device are assigned for transferring tubes to the intermediate magazine and are equipped with a control which is connected with devices for recognizing a tube situated on the tube transport device and devices for recognizing a requirement of the intermediate magazine to be refilled.

* * * * *